United States Patent [19]

Esterson et al.

[11] Patent Number: 4,700,639

[45] Date of Patent: Oct. 20, 1987

[54] UTILIZATION OF LOW GRADE FUELS

[76] Inventors: Gerald Esterson, 20 Caspi Street; Moshe Pismen, Ramot 23/9; Zeev Aizenshtat, 6 Haaluf Simhony Street, all of Jerusalem, Israel

[21] Appl. No.: 804,431

[22] Filed: Dec. 4, 1985

Related U.S. Application Data

[63] Continuation-in-part of Ser. No. 619,937, Jun. 12, 1984, abandoned.

[30] Foreign Application Priority Data

Mar. 16, 1983 [IL] Israel ..... 68149

[51] Int. Cl.[4] ..... F23D 1/00

[52] U.S. Cl. ..... 110/347; 110/245; 201/31; 201/27

[58] Field of Search ..... 122/4 D; 110/245, 263, 110/266, 347, 265; 201/27, 31

[56] References Cited

U.S. PATENT DOCUMENTS

| | | | |
|---|---|---|---|
| 2,579,397 | 12/1951 | Roetheli | 48/206 |
| 2,579,398 | 12/1951 | Roetheli | 48/206 |
| 4,026,679 | 5/1977 | Collin | 48/73 |
| 4,253,409 | 3/1981 | Wormser | 110/263 |
| 4,262,610 | 4/1981 | Hein et al. | 110/342 |
| 4,435,148 | 3/1984 | Moss | 122/4 D |
| 4,447,297 | 5/1984 | Shang et al. | 201/31 |
| 4,548,138 | 10/1985 | Korenberg | 122/4 D |
| 4,594,967 | 6/1986 | Wolowodiuk | 122/4 D |

*Primary Examiner*—Carroll B. Dority, Jr.

*Attorney, Agent, or Firm*—Fleit, Jacobson, Cohn & Price

[57] ABSTRACT

There is provided a process and reaction system for the highly efficient utilization of solid fuels with a low content of organic matter, which may have a high sulfur content and a high mineral carbonate content. Carbonate decomposition is minimized and most of the sulfur is removed from the resulting ash which can be used to make construction materials. The process is effected in 3 stages, the first two of these comprising fluidized bed operation. In the first stage pyrolysis, gasification and only partial oxidation of organic matter takes place, in the second stage combustion of residual carbon is effected in the presence of an excess of air. In the third stage the streams of combustible material coming from the first two stages are combusted. Among suitable dilute solid fuels there are low grade oil shales. The operating conditions have to be adjusted according to the nature of the solid fuel type.

4 Claims, 3 Drawing Figures

UTILIZATION OF LOW GRADE FUELS

CROSS REFERENCE TO RELATED APPLICATIONS

This application is a continuation-in-part of copending patent application Ser. No. 619,937 filed June 12, 1984 and now abandoned.

FIELD OF THE INVENTION

There is provided a process and system for utilizing in a highly efficient manner low organic material content solid fuels, as low grade oil shales and the like. The solid fuels may have a high carbonate and sulfur content. The process or combustion is effected in three separate interconnected stages. Carbonate decomposition is minimized, and sulfur is essentially removed from the resulting ash. The system for carrying out the process of the invention comprises advantageously two stages wherein fluidized beds are used. These fluidized beds can be separate or interconnected.

BACKGROUND OF THE INVENTION

Many different processes have been proposed for the combustion of fine grain dilute (low organic matter content) solid fuels. Most of these involve the direct combustion of the fuel. Amongst such fuels there are low grade oil shales which have a content of only 7 to 20 percent organic matter and which contain about 40 to 70 weight-% carbonates. When such oil shales are conbusted at above about 700° C. an endothermic decomposition of carbonate takes place, such as $$CaCO_3 \rightleftharpoons CaO + CO_2$$

with a heat of reaction of 420 Kcal/kg $CaCO_3$ and 965 kcal/kg carbon dioxide. Combustion of such oil shales above 800° C. reduces by about 20 to 40% their already low heat value, from about 800–1200 kcal/kg to about 600–900 kcal/kg.

Carbonate decomposition results in a brittle ash, and mechanical handling and abrasion cause it to collapse with the formation of dust which travels to the boiler, leading to erosion of boiler pipes and to the stack, resulting in air pollution.

In the process proposed by Rohrbach, R., "Production of Cement and Utilization of Oil Shale as a Fuel for Energy", in "United Nations Symposium on the Development ad Utilization of Oil Shale Resources, Au. 26 to Sept. 4, 1968, Tallim, USSR," Petuchov, E. F., Editor, pages 441–446, Walgus Publishing Co. (1970), fine-grain oil shale is fed to a single fluid-bed. Primary air is fed to the bottom of the fluidized combustion chamber, and secondary air is fed to the upper layers of the fluidized bed. Some of the boiler tubes are located directly in the fluidized bed and some in the steam boiler to which the hot combustion gases and fine dust flow. In this single fluidized bed, pyrolysis, gasification, oxidation of volatile gases and of carbon, and carbonate decomposition all take place simultaneously at the bed temperature of 800°–1000° C. This process of direct combustion of oil shale has the following defects. A considerable portion of the heat generated is used for carbonate decomposition and to heat the ash to a high temperature, lowering the effectiveness of electric power generation and lowering the combustion temperature. Carbonate decomposition makes the ash more brittle, and it crumbles to form dust. This dust travels to the boiler where it leads to boiler tube erosion and it goes up the stack leading to air pollution. At the combustion temperature of 800°–1000° C., most of the sulfur reacts with the mineral ash forming sulfates which render the ash useless for further use such as Portland cement manufacture, and creating a disposal nuisance.

Other fluidized bed processes, and among these the process of Roetheli, U.S. Pat. Nos. 2,579,397 and 2,579,398 produce alternative fuels, liquid and gaseous, which are transported to another location prior to combustion and which can be used as feed materials in chemical plants. The basic concept of these processes is a different one from that of the present invention.

SUMMARY OF THE INVENTION

According to the present invention there is provided a process for the utilization of low organic matter content solid fuels, such as low grade oil shale and other materials, which may have a high carbonate content and also a high content of sulfur. The combustion of the organic material is effected in 3 separate and different zones, minimizing carbonate decomposition with its energy loss (as this is an endothermic reaction), and removing a high percentage of the sulfur, resulting in an ash with a very low sulfur content which can be used for various purposes, such as use as constituent of various construction materials.

According to a preferred embodiment about one third of the overall heat generation takes place in each of the three zones. In the first zone (first stage of the process) pyrolysis and partial coke oxidation of the solid particles is carried out at a low temperature, depending on the nature of the fuel, in the range of about 350° to 700° C., limiting carbonate decomposition, while combustion of resulting gaseous material is effected in the second zone at a temperature which is generally in the range of about 800° to 1800° C.

In the second stage, the coke-combustion fluidized bed, the coked particles are combusted in a large excess of air. The combustion of the carbonaceous material in the particles is controlled by the diffusion of oxygen into the particles through the external ash layer, and is therefore slow. This limits the temperature rise of the particles due to the slowness of the exothermic reaction. Accordingly, the decomposition of carbonates can be limited to a very low level in this chamber as well. The heat generated in this fluidized bed serves to heat up the fluidizing gas (air) to a temperature of the order of 600° C., providing approximately an additional third of the total heat generated in the fuel combustor. The hot combustion gases are mixed with the combustible gases from the first chamber, and are fed to the gas-combustion chamber at a high temperature. The hot ash, at about 600° C., overflows the coke oxidation chamber to a heat-recovery system and disposal.

The mixture of combustible gases, heated combustion gases from chamber two, secondary air (if required), and carryover fines enters the third stage, the gas-combustion chamber where burning takes place at a high temperature, about 1000° C. or more, and sulfur carried overhead from chamber one in organic gases and tars and $SO_2$ is captured by the overhead fines. The amount of fines carried overhead can be controlled by the feed grinding method and other means.

Boiler tubes can be located in the second chamber for coke-oxidation, in the gas combustion chamber, and downstream, if the goal is the generation of high-pressure, supersaturated steam. In this case, the tubes in the coke-oxidation fluidized bed are not exposed to an atmosphere including condensible liquids, preventing fouling and corrosion of the tubes, because these liquids were previously removed in the pyrolysis fluidized bed.

DESCRIPTION OF THE PREFERRED EMBODIMENT

The invention is illustrated with reference to the enclosed drawings, which are of a schematical nature and not according to scale, and in which.

Figure 1:
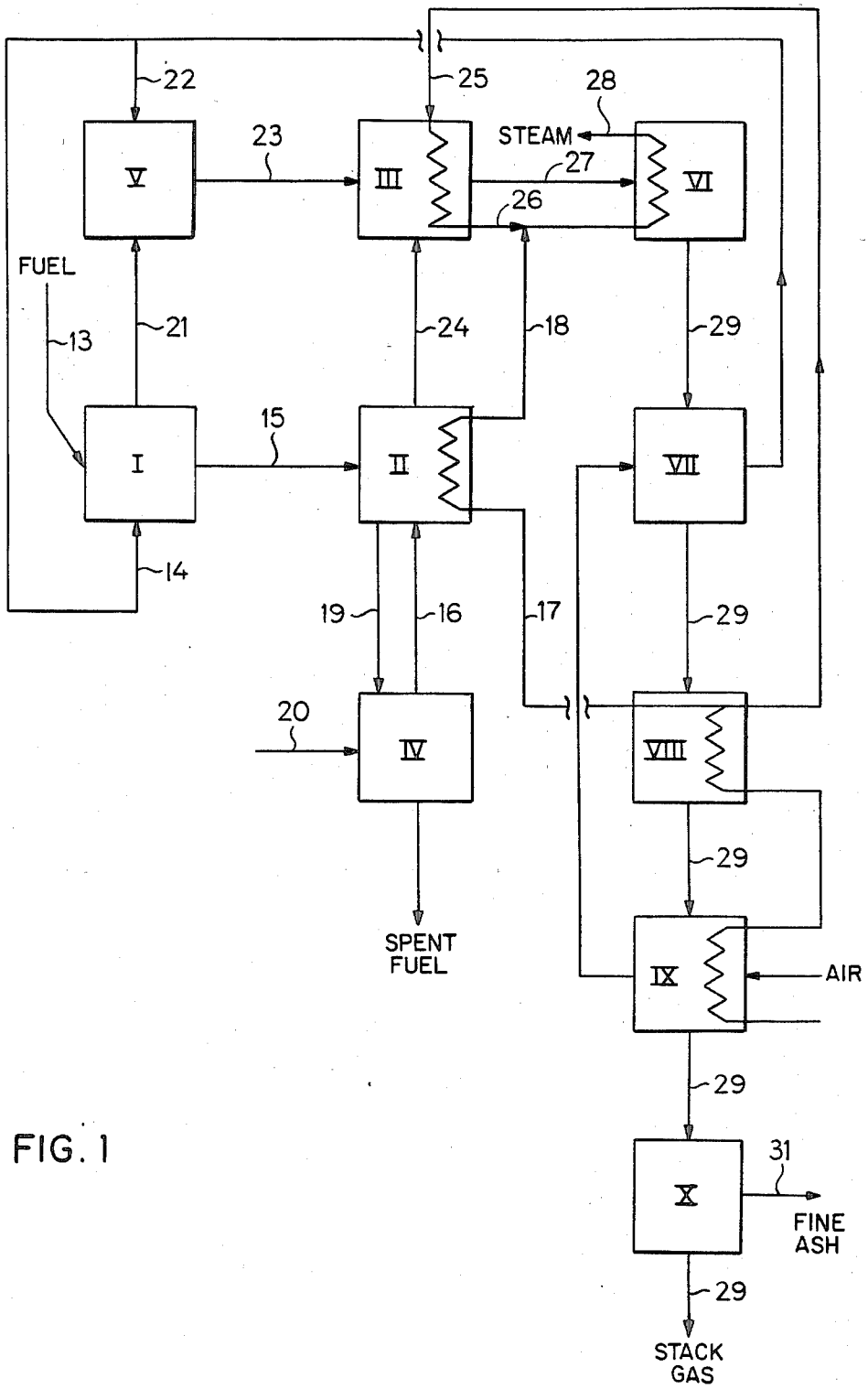
FIG. 1 is a flow sheet illustrating various possibilities of the process of the invention and of a reaction system based on the concept of this invention.

FIG. 1 presents a flowsheet of a system based on the concept set out above.

In FIG. 1, crushed fuel, say oil shale, is fed in stream 13 to the pyrolysis fluidized bed I. Air flows in stream 14 to this chamber I, preheated to 200°-600° C. by air preheaters IX and VII. The pyrolysis/gasification/partial-oxidation of the fuel in chamber I takes place at about 350°-650° C. Coked shale flows in stream 15 from chamber I to the coke-oxidation chamber II.

Air flows in stream 16 to the coke-oxidation chamber II, preheated to 100°-400° C. in ash-cooler/air-preheater IV. The oxidation of the coked shale takes place in chamber II at a temperature of 500°-700° C. The steam tubes in chamber II are fed by a high-pressure water/steam mixture, stream 17, which was preheated in water preheater VIII. The effluent steam flows in stream 18 to steam superheater VI.

The spent fuel flows from the coke-oxidation chamber II in stream 19 at 500°-700° C. to ashcooler/air-preheater IV, where both ash and air reach 100°-400° C. Unheated air is fed in stream 20 to unit IV.

The pyrolysis gas, water vapor, vaporized tar, and fine coked shale flow from pyrolysis chamber I in stream 21 to the gas mixer V. Preheated air from VII flows in stream 22 to mixer V. The mixed gases from mixer V flow in stream 23 to the gas-combustion chamber III. From coke-oxidation chamber II, there flows hot combustion gas, surplus air, water vapor, and fines in stream 24, to gas-combustion chamber III. Steam tubes located in gas-combustion chamber III receive a high-pressure water/steam mixture in stream 25 from water heater VIII, generating high-pressure steam which flows out in stream 26 to steam superheater VI.

The combustion of gases in chamber III yields a high temperature. These gases exit the chamber through stream 27, flowing to steam superheater VI, where they superheat the two flows of streams 26 and 18 to about 550°-600° C., producing product steam in stream 28. The exhaust gas flows in stream 29 from steam superheater VI to air preheater VII, then to water heater VIII and air/water preheater IX, being cooled there to about 120° C. The exhaust gas flows in stream 29 from air/water preheater IX to separator X, where the fine spent fuel is separated from the stack gas, 31.

Thus, oil shale and air are fed to the process, and high-pressure superheated steam is extracted as the product. Spent coarse ash is removed as the bottoms, and spent fines, from the overhead separator. The stack gas is free of flyash and sulfur compounds.

A schematic presentation of one embodiment of the concept described above is given in FIG. 2. In this Figure a triple-stage system is illustrated: I is the pyrolysis chamber, II is the coke-oxidation chamber, and III is the gas-combustion chamber.

Fine-grain solid fuel in the size range of about 0-15 mm, containing 4-20 percent fines (0-0.3 mm), flows from the feed hopper 1 by way of the feed line 2 and the feed-rate control mechanism 3 to fluidized bed 11. Air preheated to 20°-600° C. is fed through the air distribution plate 4 to the chamber I, fluidizing the solid particles therein. Pyrolysis and gasification of the fuel takes place at the bed temperature of 350°-700° C., and partial oxidation of the coke at the particle surface, and some of the pyrolysis/gasification products, takes place. The heat generated by this oxidation heats the feed particles up to bed temperature and supplies the heat necessary for other reactions occurring in this fluidized bed.

The pyrolysis/gasification/oxidation products exit the fluidized bed overhead, and the coked particles exit the bed through the holes in the partition separating the first fluidized bed 11 from the second fluidized bed 11.

The levels of the two fluidized beds 11, 11' in chambers I and II are nearly the same, because the holes in the separating wall effectively form these two chambers into the two arms of a manometer, the two-phase fluids forming the manometer fluid. A momentary rise in the level of the fluidized bed in the first chamber due to addition of fresh feed, results in the flow of solid particles to the second chamber through the partition holes, automatically maintaining the proper fluidized bed heights. The openings 5 in the partition wall must be below the top of the fluidization zone.

The coked particles flowing from chamber I through holes 5 to chamber II, enter the fluidized bed which operates in the temperature range 500°-700° C. Preheated air from the heat-recovery system and ash cooler IV enters the fluidized bed through the air distribution plate 7, fluidizing the solid particles. This air can be fed in an excess, say, 50-300 percent, of that necessary for coke-oxidation, thus preheating air for the gas-combustion chamber III. The amount of oxygen in chamber II is more than sufficient to oxidize totally the coke in the solid particles received from chamber I. Due to the ash layer which is formed in chamber I, the diffusion of oxygen into the particles is slowed down and the coke oxidation is slow, limiting temperature rise in the particles, which remain very close to the bed average temperature; this keeps the decomposition of carbonates and the resulting heat loss at a very low level.

Spent fuel particles leave the coke-oxidation chamber II by overflow through the exit tube 8, entering the spent fuel cooler and heat-recovery system IV. In this example, the heat-recovery system operates as a fluidized bed in which both the ash particles and the fluidizing air reach a common average temperature. The cooled ash leaves chamber IV by overflow at a temperature of 100°-400° C., depending on the design, and goes to the ash disposal system. The preheated air flows to chamber II through the distributor plate 7. The ash has a very low level of residual carbonaceous material, typically 0.2-0.5 percent, leading to a very high utilizing of the organic material in the feed.

Combustible gases, tar, and noncombustible gases from chamber I are mixed with the combustion gases from chamber II, and with secondary air (if required) in mixer/gas-burner 10, and burning occurs in chamber III at temperatures of 800°-1800° C. Any overhead fines which flow with the gases from chambers I and II reach a high temperature in chamber III, and serve the function of capturing sulfur in this chamber.

Figure 3:
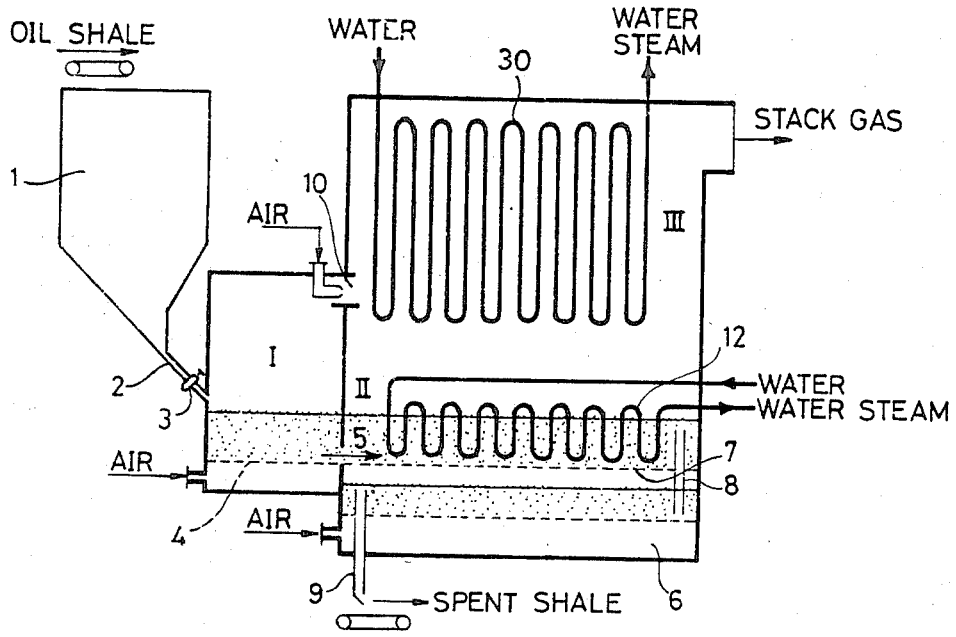
FIG. 3 is an elevational side-view of another embodiment of a reaction system of the invention.

FIG. 3 presents schematically a different embodiment of reaction system. In this:

(a) The gas-combustion chamber III is not physically separated from chamber II.

(b) The walls of chamber III are provided with tubes 30 for radiative heat transfer, thus transforming chamber III into a radiation section of a steam boiler.

(c) If necessary, steam or water-preheater tubes may be provided in chamber II, these tubes 12, serving dual purpose of preheating the working fluid and controlling the temperature of the fluidized bed in chamber II.

Figure 2:
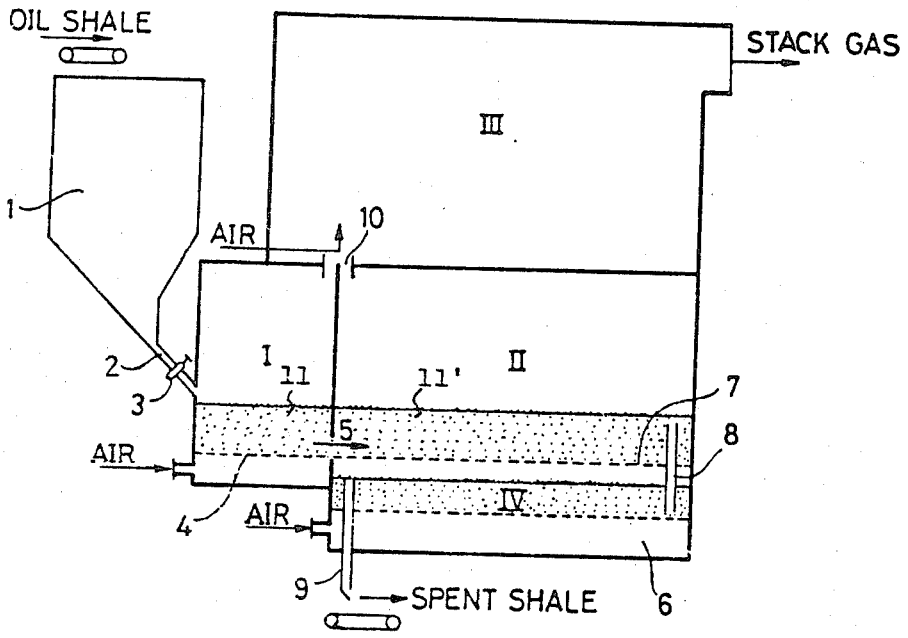
FIG. 2 is an elevational side-view of a reaction system of the invention.

In FIG. 2, high temperature combustion gases are generated in the combustor, and are then fed to a downstream boiler or other device for use there.

In FIG. 3, heat is transferred directly to the water or steam in the combustor itself, the effluent gas leaving at a lower temperature than in FIG. 2. Other variations are possible.

The following example presents the results of utilizing the above invented process to combust Israeli oil shale from the Zefa Ef'e site. A typical composition of this oil shale is as follows:

| Organic matter: | | | |
|---|---|---|---|
| C | 10.07% | $CO_2$ (mineral) | 24.6 |
| H | 1.19 | Ash | 57.2 |
| N | 0.32 | Water | 2.9 |
| S | 1.38 | | |
| O | 2.34 | L.C.V. | 1066 kcal/kg |
| | 15.3 | | |

When this oil shale is pyrolyzed at moderate temperatures such as set out above, 50 grams of tarry material per cubic meter of gas effuent from the pyrolysis fluidized bed are produced. The L.C.V. of this pyrolysis gas, including the tar, is 1530 kcal/cu mtr of pyrolysis gas. The pyrolyzed (coked) shale contains 1.1. percent carbon which is then oxidized in the coke-oxidation chamber, producing heat.

After oxidation of the coked shale in the second fluidized bed, the resulting ash contains only 0.3 percent carbon and 0.1 percent organic sulfur. The overall carbonate decomposition is 20 percent or less, including both the coarse ash and the overhead fines which are elutriated from the two fluidized beds.

When the effluent gas from pyrolysis chamber I is burned in gas-combustion chamber III with hot residual oxygen in the combustion gas from coke-oxidation chamber II and with secondary oxygen, a temperature of about 1750° C. is attained in an ordinary gas combustion chamber. The content of $SO_2$ in the stack gas which leaves the process is only 50–60 ppm, well below legal requirements. The overall combustion efficiency of the process using Israeli oil shale is nearly 90 percent.

The spent shale which leaves the process has the same particle size distribution as the feed material, meaning that little attrition or agglomeration has occurred and that little fine material or dust has been generated. Thus, the ash disposal or further processing may occur with minimal problem. This is because the processing of the original fuel in the novel process is mild in nature, even though it converts nearly all of the original organic material to useful product (thermal energy).

Table 1 presents an overall mass and energy balance for the example combustor shown in FIG. 2, utilizing Israeli oil shale ground to a size range of 0–15 mm.

Table 2 presents an overall mass and energy balance for the example combustor shown in FIG. 2, utilizing sub-bituminous coal concentrate as feed, another low-grade fuel material.

Table 3 presents an overall mass and energy balance for the example combustor shown in FIG. 2, utilizing oil sand as feed, another low-grade fuel material.

In each of the above examples, an industrial-level of combustion efficiency can be attained with the process of the invention.

TABLE 1

Overall Mass and Energy Balances
Oil Shale Feed

| | Quantity Kg. | Quantity $M^3$ | Kcal per unit | Enthalpy Kcal | Percent |
|---|---|---|---|---|---|
| Inflow: | | | | | |
| 1. Oil Shale L.C.V. | 1.0 | — | 1066. | 1066. | 100.0 |
| 2. Air at 300° C. | — | 0.327 | 94.4 | 30.9 | 2.9 |
| | | | | 1096.9 | 102.9 |
| Outflow: | | | | | |
| 1. Combustion gas at 1750° C. | — | 1.133 | — | 957.6 | 89.8 |
| 2. Spent shale L.C.V. | 0.785 | — | 33.5 | 26.3 | 2.5 |
| 3. Spent Shale at 378° C. | 0.785 | — | 94.5 | 74.4 | 7.0 |
| 4. Carbonate Decomposition | 0.036 | — | 965. | 34.7 | 3.2 |
| 5. Heat Loss | — | — | — | 3.9 | 0.4 |
| | | | | 1096.9 | 102.9 |

TABLE 2

Overall Mass and Energy Balances
Waste Product from Sub-bituminous
Coal Concentration (Rock)

| | Quantity Kg. | Quantity $M^3$ | Kcal per unit | Enthalpy Kcal | Percent |
|---|---|---|---|---|---|
| Inflow: | | | | | |
| 1. Rock concentrate L.C.V. | 1.0 | — | 1367. | 1367. | 100.0 |
| 2. Air at 300° C. | — | 0.578 | 94.4 | 54.6 | 4.0 |
| | | | | 1421.6 | 104.0 |
| Outflow: | | | | | |
| 1. Combustion gas at 1600° C. | — | 1.8 | 628.8 | 1131.9 | 82.8 |
| 2. Spent fuel at 855° C. | 0.7556 | — | 239.4 | 180.9 | 13.2 |
| 3. Spent fuel L.C.V. | 0.7556 | — | 73.0 | 72.7 | 5.3 |
| 4. Heat Loss | — | — | — | 36.1 | 2.7 |
| | | | | 1421.6 | 104.0 |

TABLE 3

Overall Mass and Energy Balances
Oil Sand Feed

| | Quantity Kg. | Quantity $M^3$ | Kcal per unit | Enthalpy Kcal | Percent |
|---|---|---|---|---|---|
| Inflow: | | | | | |
| 1. Oil Sand L.C.V. | 1.0 | — | 861.0 | 861.0 | 100.0 |
| 2. Air at 300° C. | — | 0.109 | 94.4 | 10.3 | 1.2 |
| | | | | 871.3 | 101.2 |
| Outflow: | | | | | |

TABLE 3-continued

| Overall Mass and Energy Balances Oil Sand Feed | Quantity Kg. | Quantity $M^3$ | Kcal per unit | Enthalpy Kcal | Percent |
|---|---|---|---|---|---|
| 1. Combustion gas at 1980° C. | — | 0.876 | 787.7 | 690.0 | 80.1 |
| 2. Spent fuel at 600° C. | 0.905 | — | 150.0 | 135.0 | 15.7 |
| 3. Spent fuel L.C.V. | 0.905 | — | 48.6 | 44.0 | 5.1 |
| 4. Heat Loss | — | — | — | 2.3 | 0.3 |
| | | | | 871.3 | 101.2 |

We claim:

1. A process for the combustion of solid fuels of low content of organic matter, of high sulfur and carbonate content, containing pyrolyzable constituents, which comprises the steps of:

establishing a first treatment zone;

introducing into the first treatment zone a comminuted solid fuel with a particle size of less than about 15 mm and containing from about 2% to about 20% by weight of fines and containing from about 7% to about 20% by weight of organic matter, containing a high sulfur content, and containing from about 40% to about 70% by weight carbonates;

introducing into the bottom of the first treatment zone a gaseous medium preheated to from about 50° C. to about 600° C. to fluidize the comminuted solid fuel and to create a first fluidized bed;

establishing a second treatment zone;

pyrolyzing and gasifying organic matter in the first fluidized bed within the temperature range of from about 350° C. to about 700° C. while minimizing carbonate decomposition;

transferring solid residue of coked particles from the first fluidized bed in the first treatment zone to the second treatment zone;

introducing preheated air into said second treatment zone in an amount from about 50% to about 300% of that necessary for coke oxidation to fluidize the particles in said second treatment zone to create a second fluidized bed;

burning residual carbonaceous matter in the solid residue transferred from the first treatment zone into said second treatment zone and in the second fluidized bed within the temperature range of from about 500° C. to about 700° C.;

overflowing spent fuel particles from the second fluidized bed to exhaust same from said second treatment zone;

said first and second fluidized beds being in communication below the surface of the beds to effect the aforementioned transfer whereby as additional comminuted solid fuel is introduced into the first treatment zone, solid residue from the first fluidized bed will be transferred to the second fluidized bed;

establishing a third treatment zone above and contiguous to both said first and second treatment zones;

transferring combustion gases, tar, and non-combustible gases from the first treatment zone to the third treatment zone;

transferring combustion gases from the second treatment zone to the third treatment zone;

mixing the combustible gases, tar and non-combustible gases from the first treatment zone with the combustion gases from the second treatment zone and directly combusting the mixture in said third treatment zone at a temperature in the range of from about 800° C. to about 1800° C.

2. A process according to claim 1, where the gaseous medium is a stream of air or other suitable oxidizing gaseous medium.

3. A process according to claim 1, including passing fines contained in the main feed to the third treatment zone by means of gases passing thereto from the first and second treatment zones and reacting said fines with sulfur-containing gases in the third treatment zone to form calcium sulfate or other solid sulfates, removing said sulfates from the gaseous effluents from the third treatment zone.

4. A process according to claim 3, wherein said fines are lime or carbonates which react with sulfur-containing gases to form calcium sulfate.

* * * * *